US007879286B2

(12) United States Patent
Miracle et al.

(10) Patent No.: US 7,879,286 B2
(45) Date of Patent: Feb. 1, 2011

(54) METHOD OF PRODUCING HIGH STRENGTH, HIGH STIFFNESS AND HIGH DUCTILITY TITANIUM ALLOYS

(76) Inventors: Daniel B. Miracle, 2237 Shadowood Cir., Bellbrook, OH (US) 45305; Seshacharyulu Tamirisakandala, 2634 Thomas Jefferson Dr., Beavercreek, OH (US) 45434; Radhakrishna B. Bhat, 1505 Wheatly Ct., Niskayuna, NY (US) 12309; Dale J. McEldowney, 13250 Sycamore Trail, Anna, OH (US) 45302; Jerry L. Fields, 633 Wisman Rd., Woodstock, VA (US) 22665; William M. Hanusiak, 4430 Indian Deer Rd., Windermere, FL (US) 34786; Rob L. Grabow, 80 Canterbury Dr., Clarksburg, WV (US) 26301; C. Fred Yolton, 1511 Charleton Heights Rd., Coraopolis, PA (US) 15108; Eric S. Bono, 1274 Cambridge Rd., McDonald, PA (US) 15657

( * ) Notice: Subject to any disclaimer, the term of this patent is extended or adjusted under 35 U.S.C. 154(b) by 234 days.

(21) Appl. No.: 11/448,160

(22) Filed: Jun. 7, 2006

(65) Prior Publication Data

US 2007/0286761 A1 Dec. 13, 2007

(51) Int. Cl.
*C22F 1/18* (2006.01)

(52) U.S. Cl. ..... 419/12; 148/513; 148/671

(58) Field of Classification Search ..... None
See application file for complete search history.

(56) References Cited

U.S. PATENT DOCUMENTS 3,379,522 A 4/1968 Vordahl
4,639,281 A 1/1987 Sastry et al.
5,041,262 A * 8/1991 Gigliotti, Jr. ..... 420/419
5,580,665 A * 12/1996 Taguchi et al. ..... 428/550
7,410,610 B2 * 8/2008 Woodfield et al. ..... 419/34

OTHER PUBLICATIONS

Marray JL, Liao PK, Spear KE, In: Baker H. editor. Binary alloy phase diagrams. Materials Park, OH; ASM International; 1992, p. 285.

Materials Properties Handbook: Titanium Alloys, eds. R.R. Boyer, E.W. Collings, and G.E. Welsch, ASM International, Materials Park, OH, 2004.

Tamirisakandala et al., "Powder Metallurgy Ti-6AI-4V-xB Alloys: Processing, Microstructure, and Properties", JOM, May 2004, pp. 60-63.

Tamirisakandala et al., "Effect of boron on the beta transus of Ti-6AI-4V alloy", Scripta Materialia, 53, 2005, pp. 217-222.

* cited by examiner

*Primary Examiner*—George Wyszomierski
(74) *Attorney, Agent, or Firm*—Nixon & Vanderhye, PC

(57) ABSTRACT

A method of producing a high strength, high stiffness and high ductility titanium alloy, comprising combining the titanium alloy with boron so that the boron concentration in the boron-modified titanium alloy does not exceed the eutectic limit. The carbon concentration of the boron-modified titanium alloy is maintained below a predetermined limit to avoid embrittlement. The boron-modified alloy is heated to a temperature above the beta transus temperature to eliminate any supersaturated excess boron. The boron-modified titanium alloy is deformed at a speed slow enough to prevent microstructural damage and reduced ductility.

38 Claims, 3 Drawing Sheets

FIG. 5a
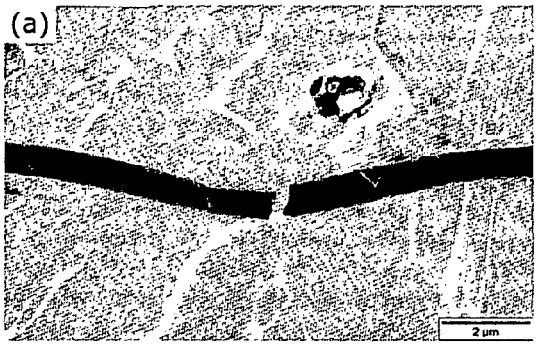
FIG. 5b
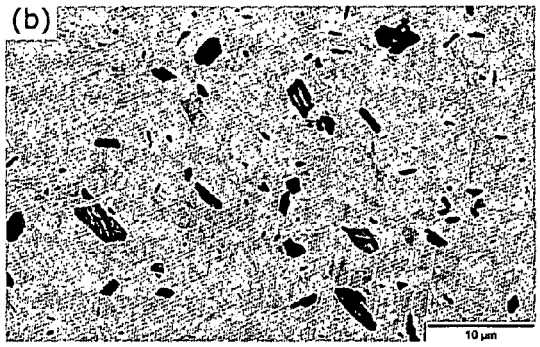
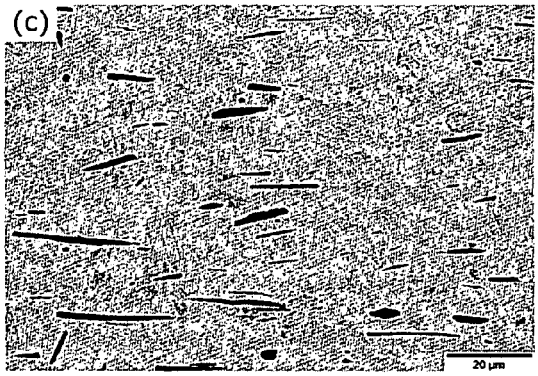
FIG. 5c
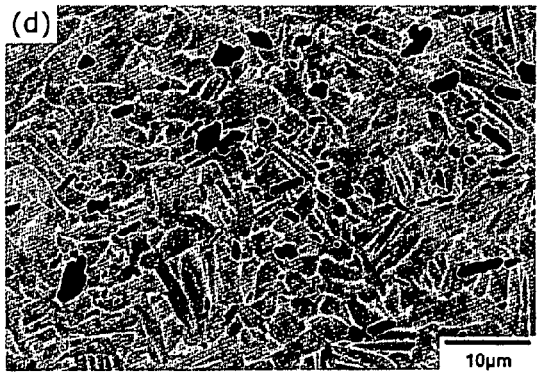
FIG. 5d
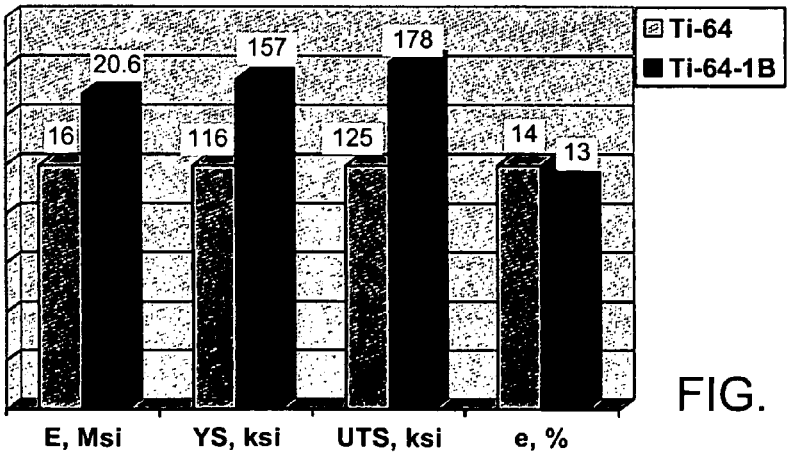
FIG. 6

METHOD OF PRODUCING HIGH STRENGTH, HIGH STIFFNESS AND HIGH DUCTILITY TITANIUM ALLOYS

STATEMENT REGARDING FEDERALLY SPONSORED RESEARCH OR DEVELOPMENT

The present invention may be manufactured and used by or for the Government of the United States for all governmental purposes without the payment of any royalty.

CROSS-REFERENCES TO RELATED APPLICATIONS

N/A

REFERENCE TO A MICROFICHE APPENDIX

N/A

BACKGROUND OF THE INVENTION

1. Field of the Invention

The present invention relates generally to methods for enhancing the performance of conventional titanium alloys without a reduction in damage tolerance and, more specifically, to a method for producing homogeneous microstructure in the broad family of titanium alloys including, but not limited to Ti-6 wt. % Al-4 wt. % V, Ti-5Al-2.5Sn, Ti-6Al-2Sn-4Zr-2Mo-O.1Si.

2. Description of the Background Art

Titanium alloys offer attractive physical and mechanical property combinations that make them suitable for a variety of structural applications in various industries (e.g. aerospace) to obtain significant weight savings and reduced maintenance costs compared to other metallic materials such as steels. There have been several efforts to further increase the strength and stiffness of conventional titanium alloys to obtain enhanced performance. These approaches involve addition of particulates, short fibers, or continuous fibers that possess high strength and stiffness. Although these prior art approaches increase the strength and stiffness of conventional titanium alloys significantly, the increases are obtained with an accompanying drastic reduction in ductility and damage tolerance owing to the presence of brittle reinforcement, which restricts their usage in fracture-sensitive applications. A value of 5% tensile elongation is often considered in structural applications to separate ductile from brittle behavior.

Accordingly, a purpose of the present invention is to provide a novel methodology for producing titanium alloys with significant enhancement in strength and stiffness relative to conventional titanium alloys while maintaining adequate ductility. The method described herein involves addition of a small amount of boron below a critical level, and deforming the alloy at a specified range of temperature and deformation rate, to obtain uniform microstructure.

BRIEF SUMMARY OF THE INVENTION

In accordance with the new and improved method of the present invention, the strength and stiffness of titanium alloys are increased, while maintaining ductility, by the addition of boron and controlled processing to obtain uniform microstructure.

Important features of the present method are as follows:

1. The boron concentration in the titanium alloy should be at or below the eutectic limit so that it does not possess any coarse primary TiB particles;

2. The titanium alloys containing boron are heated above the beta transus temperature (temperature at which the titanium alloy transforms fully to high temperature body-centered cubic beta phase) to completely force out any supersaturated boron (boron trapped inside the lattice of titanium under non-equilibrium solidification conditions); and 3. The boron-modified titanium alloy is subjected to deformation at a slow rate, e.g., extrusion at slow speed, to avoid damage to the TiB micro-constituent which reduces ductility.

BRIEF DESCRIPTION OF THE DRAWINGS

FIG. 2(*b*) is a fractograph of a tensile specimen showing preferential crack initiation at coarse primary TiB particles;

FIG. 3(*b*) is a graph of ductility versus temperature in an extruded Ti-6Al-4V-1B alloy with different carbon concentrations;

FIG. 4(*b*) is a backscattered electron micrograph of a Ti-6Al-4V-1B alloy compacted at 1980° F. (above the beta transus);

FIG. 5(*a*)) is a backscattered electron micrograph of a Ti-6Al-4V-1B-0.1C alloy extruded at a ram speed of 100 inch/min., taken along the extrusion direction;

FIG. 5(*b*) is a backscattered electron micrograph of a Ti-6Al-4V-1B-0.1C alloy extruded at a ram speed of 100 inch/min., taken along the transverse direction;

FIG. 5(*c*) is a backscattered electron micrograph of a Ti-6Al-4V-1B-0.1C alloy extruded at a ram speed of 15 inch/min., taken along the extrusion direction;

FIG. 5(*d*) is a backscattered electron micrograph of a Ti-6Al-4V-1B-0.1C alloy extruded at a ram speed of 15 inch/min., taken along the transverse direction; and FIG. 6 is a graph showing the tensile properties of a slow speed extruded Ti-6Al-4V-1B alloy as compared with a typical Ti-6Al-4V alloy

DETAILED DESCRIPTION OF THE INVENTION

The present invention provides a novel method of increasing the strength and stiffness while maintaining the ductility of titanium alloys by the addition of boron and controlled processing. This new and improved method causes the natural evolution of fine and uniform microstructural features. Although the description hereinafter is specific to a powder metallurgy processing technique, the invention is equally applicable to other metallurgical processing techniques.

In the pre-alloyed powder metallurgy approach, the boron is added to the molten titanium alloy and the melt is atomized to obtain boron-containing titanium alloy powder. The powder may be consolidated and/or formed via conventional techniques such as hot isostatic pressing, forging, extrusion and rolling.

The method of the present invention includes four important elements which are described hereinafter.

1) Boron Level at or Below the Eutectic Limit

Figure 1:
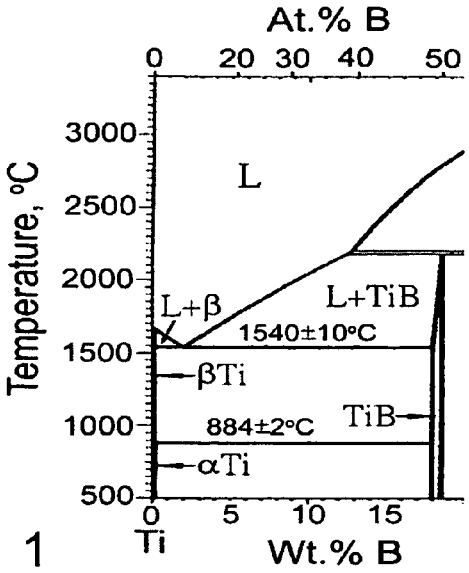
FIG. 1 is a binary titanium-boron phase diagram.
Figure 2A:
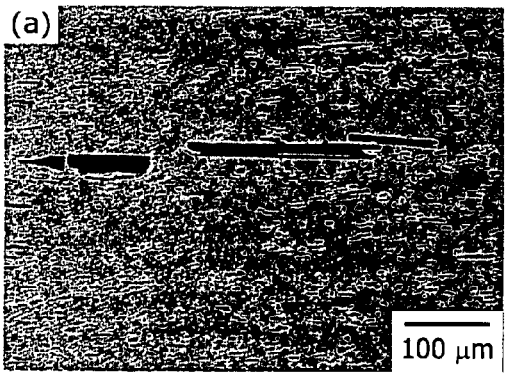
FIG. 2(*a*) is an electron micrograph of coarse primary TiB particles in a titanium alloy composition (Ti-6Al-4V-1.7B) above the eutectic limit.
Figure 2B:
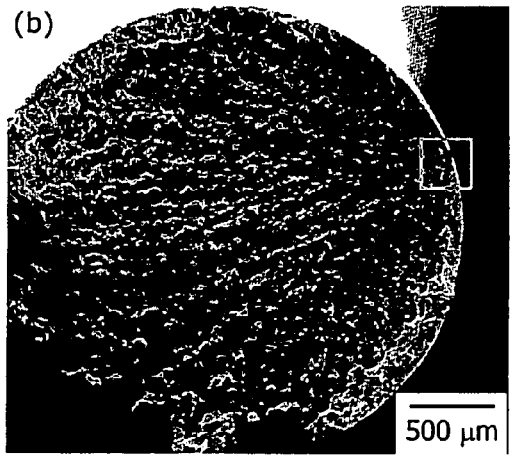

While boron is fully soluble in liquid titanium, its solubility in the solid phase is negligible. The binary Titanium-Boron phase diagram shown in FIG. 1 illustrates that there exists an eutectic reaction at a temperature of 2804° F. (1540° C.) and boron concentration of 2 wt. %. Similar eutectic reactions are expected in other titanium alloys modified with boron with a change in the eutectic temperature and boron concentration. When alloys with compositions that contain boron concentrations above the eutectic limit are solidified, very coarse primary TiB particles grow in the two phase (liquid plus TiB) region and are retained in the fully solidified microstructure. Although these particles provide significant strength and stiffness improvements, drastic reduction in ductility occurs. An example of the effect of the coarse primary TiB particles is illustrated in FIG. 2 for a Ti-6Al-4V-1.7B (all concentrations expressed in weight percent) alloy which is above the eutectic composition for this titanium alloy. The presence of coarse TiB particles larger than 200 μm is seen in FIG. 2(*a*) and the preferential initiation of fracture at these particles in a tensile specimen causing premature failure (ductility of ~3%) is recorded in FIG. 2(*b*). Therefore, the present invention is applicable to any conventional titanium alloy that contains boron concentration below the eutectic limit and that does not possess any of the coarse primary TiB particles.

2) Carbon Level Below a Critical Limit

Figure 3A:
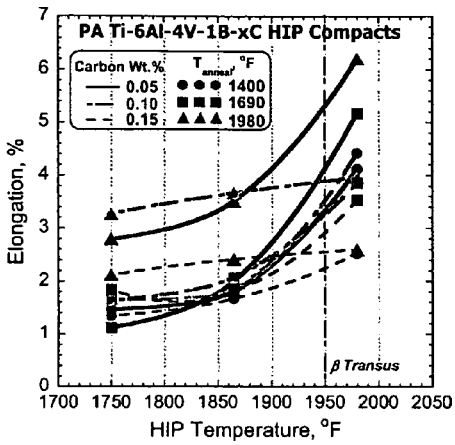
FIG. 3(*a*) is a graph of ductility versus temperature in as-compacted Ti-6Al-4V-1B alloy with different carbon concentrations.
Figure 3B:
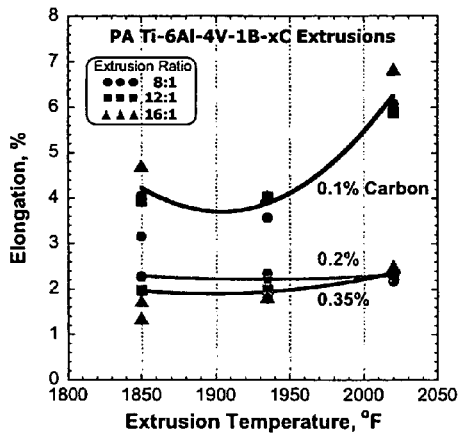

It has been discovered that the carbon concentration also significantly influences the ductility of boron-modified titanium alloys and it is important to keep the carbon level below below a critical limit to avoid an unacceptable loss of ductility. Unlike boron, the solid solubility of carbon in titanium is high (up to 0.5 weight %) and carbon in titanium could cause embrittlement. The carbon concentration, therefore, should be controlled depending on the alloy composition and processing parameters to achieve acceptable ductility values. For example, FIG. 3 shows results from a study of a Ti-6Al-4V-1B alloy with varying carbon concentrations from 0.05 to 0.35% in as-compacted (FIG. 3*a*) and extruded (FIG. 3*b*) conditions. For the selected process conditions, these variations illustrate that the ductility significantly drops to below 4% for carbon concentrations above 0.1%.

3) Thermal Exposure Above the Beta Transus

Owing to negligible solid solubility of boron in titanium, excess boron is trapped (supersaturated) inside the lattice of titanium under non-equilibrium solidification conditions (e.g. powder manufacture via rapid solidification techniques such as gas atomization). Titanium alloy with supersaturated boron is inherently brittle and possesses low ductility values. It has been discovered that the supersaturated boron can be forced out via thermal exposure at a high temperature. Experiments to determine the optimum temperature for eliminating the supersaturation are illustrated in FIG. 3. From these experiments, it is concluded that the material should be exposed above the beta transus temperature (temperature at which the titanium alloy transforms fully to high temperature body-centered cubic beta phase) to completely force out the supersaturated boron. Thermal exposure also influences microstructural parameters such as size, distribution, and inter-particle spacing of TiB particles, and grain size and morphology of the titanium phases. These microstructural parameters significantly influence the mechanical properties.

Figure 4A:
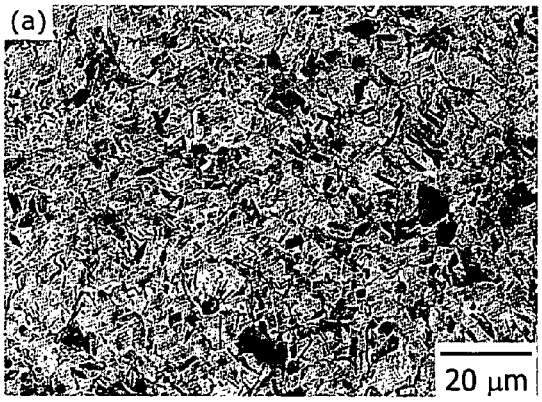
FIG. 4(*a*) is a backscattered electron micrograph of a Ti-6Al-4V-1B alloy compacted at 1750° F. (below the beta transus)
Figure 4B:
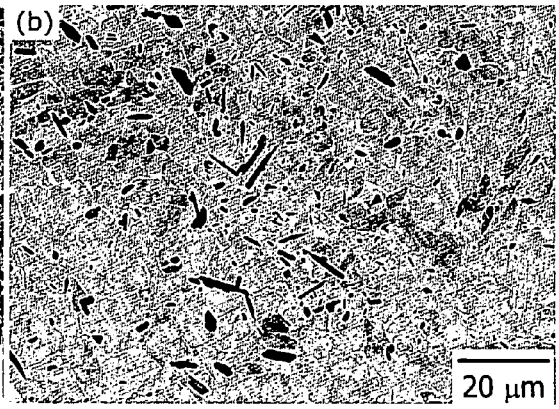

Thermal exposure at lower temperatures results in close inter-particle spacing which restricts the ductility. Exposure above the beta transus increases the inter-particle spacing which improves the ductility. The rate at which the material is cooled after thermal exposure alters the grain size and morphology, both of which also significantly influence the ductility. Controlled slow cooling from above the beta transus produces fine-grained equiaxed alpha-beta microstructure due to the influence of TiB particles on the phase transformation reaction of high temperature beta to room temperature alpha. The beta transus varies with the composition of principal alloying elements in conventional titanium alloys, and, e.g., is 1850±50° F. for Ti-6Al-4V. Thermal exposure may be applied via hot isostatic pressing, extrusion, or another suitable consolidation method, or by thermal treatment before or after consolidation, or thermo-mechanical processing. The effects of thermal treatments in HIP compacts and extrusions are shown in FIG. 3. Microstructures of Ti-6Al-4V-1B powder compacted below and above the beta transus are shown in FIG. 4, which clearly demonstrates the influence of thermal exposure temperature on the microstructural evolution.

4) Deformation Rate Control to Avoid Microstructural Damage

The rate at which boron-modified titanium alloy is subjected to deformation also has significant influence on the final microstructure and mechanical properties. Microstructures of Ti-6Al-4V-1B-0.1C material extruded at a fast ram speed (100 inch/mm) and slow speed (15 inch/mm) are shown in FIG. 5. The material extruded at high-speed (FIGS. 5*a* and 5*b*) exhibited microstructural damage manifested as TiB particle fracture and cavitation at the ends of TiB, which reduce the ductility. The material extruded at slow-speed (FIGS. 5*c* and 5*d*), on the other hand, is completely free from microscopic damage. Although, the demonstrations are made using selected processes and deformation rates, the method of this invention is applicable to the full range of consolidation approaches and thermo-mechanical processes, and covers a broad range of safe deformation rates necessary to avoid damage to the TiB microconstituent.

The properties of slow-speed extruded Ti-64-1B are compared with a typical Ti-6Al-4V alloy [2] in FIG. 6. An increase in stiffness (modulus) by −25% and strength by −35%, while maintaining equivalent ductility level (>10%), is obtained in boron-modified Ti alloy processed under controlled conditions described above.

It will be readily seen, therefore, that the new and improved method of the present invention increases the strength and stiffness of conventional titanium alloys without significant loss in ductility, thus significantly enhancing the structural performance of titanium alloys.

Boron-modified titanium alloys could be produced using traditional processing methods and conventional metalworking (e.g. forging, extrusion, rolling) equipment can be used to perform controlled processing. Therefore, the improved performance with the use of the present method is obtained without any increase in material or processing cost.

Titanium alloys with 25-35% increases in strength and stiffness could replace existing expensive components for high performance and could enable new structural design concepts for weight and cost reduction.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A method of producing a high strength, high stiffness and high ductility titanium alloy, the method comprising:

alloying a titanium alloy with boron so that the boron concentration in the boron-modified titanium alloy does not exceed the eutectic limit;

maintaining the carbon concentration of the boron-modified titanium alloy below a predetermined limit to avoid embrittlement of the boron-modified titanium alloy;

heating the boron-modified alloy to a temperature above the beta transus temperature to force supersaturated boron out of a titanium lattice of the boron-modified titanium alloy and to increase an inter-particle spacing of a titanium boride microconstituent; and deforming the boron-modified titanium alloy at a speed that avoids damage to the titanium boride microconstituent of the boron-modified titanium alloy.

2. The method of claim 1 wherein the boron is added to a molten titanium alloy and the melt is atomized to obtain boron-containing titanium alloy powder.

3. The method of claim 2 wherein the boron-containing titanium alloy powder is consolidated and/or formed by hot isostatic pressing, forging, extrusion or rolling.

4. The method of claim 2 wherein the boron is in liquid or powder form.

5. The method of claim 1 wherein the titanium alloy is selected from the group consisting of Ti-6Al-4V, Ti-5Al-2.5Sn and Ti-6Al-2Sn-4Zr-2Mo-0.1Si.

6. The method of claim 1 wherein the boron-modified alloy heated above the beta transus temperature is cooled at a rate slow enough to prevent reduced ductility.

7. The method of claim 1, wherein the steps of heating the boron-modified titanium alloy and deforming the boron-modified titanium alloy are conducted simultaneously.

8. The method of claim 1, wherein deforming the boron-modified titanium alloy comprises at least one of forging, extruding, and rolling the boron-modified titanium alloy.

9. The method of claim 8, wherein deforming the boron-modified titanium alloy comprises extruding the boron-modified titanium alloy at a ram speed no greater than 15 inch/mm.

10. The method of claim 1, wherein the carbon concentration of the boron-modified titanium alloy is no greater than 0.1 weight percent.

11. A method of processing a titanium alloy, the method comprising:

alloying a molten titanium alloy with boron to form a boron-modified titanium alloy melt, wherein the concentration of boron in the melt is below the eutectic limit of boron in the titanium alloy;

atomizing the melt to form a boron-containing titanium alloy powder;

heating the boron-containing titanium alloy powder to a temperature above a beta transus temperature of the boron-containing titanium alloy powder to force supersaturated boron out of a titanium lattice of the boron-containing titanium alloy powder and to increase an inter-particle spacing in a distribution of titanium boride particles in the boron-containing titanium alloy powder.

12. The method of claim 11, further comprising maintaining the carbon concentration of the boron-containing titanium alloy powder below a predetermined limit to avoid embrittlement.

13. The method of claim 12, wherein the predetermined limit is no greater than 0.1 weight percent.

14. The method of claim 11, further comprising cooling the boron-containing titanium alloy powder from the temperature above the beta transus temperature at a rate slow enough to prevent reduced ductility.

15. The method of claim 11, wherein heating further comprises consolidating the boron-containing titanium alloy powder at a deformation rate that avoids damage to the titanium boride particles of the boron-containing titanium alloy powder, to provide a consolidated boron-modified titanium alloy powder.

16. The method of claim 15, wherein consolidating the boron-modified titanium alloy powder comprises at least one of hot isotactic pressing and extruding the boron-containing titanium alloy powder.

17. The method of claim 16, wherein consolidating the boron-modified titanium alloy powder comprises extruding the boron-modified titanium alloy powder at a ram speed no greater than 15 inch/mm.

18. The method of claim 15, further comprising thermomechanically processing the consolidated boron-containing titanium alloy powder at a deformation rate that avoids damage the titanium boride particles of the consolidated boron-containing titanium alloy powder.

19. The method of claim 18, wherein thermomechanically processing the consolidated boron-modified titanium alloy powder comprises at least one of forging, extruding, and rolling the consolidated boron-modified titanium alloy powder.

20. The method of claim 18, wherein thermomechanically processing the consolidated boron-modified titanium alloy powder comprises extruding the consolidated boron-modified titanium alloy powder at a ram speed no greater than 15 inch/mm.

21. The method of claim 11, further comprising, subsequent to heating the boron-containing titanium alloy powder above the beta transus temperature, consolidating the boron-containing titanium alloy powder at a deformation rate that avoids damage to the titanium boride particles of the boron-containing titanium alloy powder.

22. The method of claim 21, wherein consolidating the boron-containing titanium alloy powder comprises one of hot isotactic pressing and extruding the boron-containing titanium alloy powder.

23. The method of claim 22, wherein consolidating the boron-containing titanium alloy powder comprises extruding the consolidated boron-modified titanium alloy powder at a ram speed no greater than 15 inch/mm.

24. The method of claim 21, further comprising thermomechanically processing the consolidated boron-containing titanium alloy powder at a deformation rate that avoids damage the titanium boride particles of the titanium alloy.

25. The method of claim 24, wherein thermomechanically processing the consolidated boron-containing titanium alloy powder comprises at least one of forging, extruding, and rolling the consolidated boron-containing titanium alloy powder.

26. The method of claim 25, wherein thermomechanically processing the consolidated boron-containing titanium alloy powder comprises extruding the boron-modified titanium alloy powder at a ram speed no greater than 15 inch/mm.

27. The method of claim 11, wherein the boron is in liquid or powder form.

28. The method of claim 11, wherein the molten titanium alloy is selected from the group consisting of Ti-6Al-4V alloy, Ti-5Al-2.5Sn alloy, and Ti-6Al-2Sn-4Zr-2Mo-0.1Si alloy.

29. A method of processing a titanium alloy, the method comprising:

alloying a molten titanium alloy with boron to form a boron-modified titanium alloy melt, wherein the concentration of boron in the melt is below the eutectic limit of boron in the titanium alloy;

atomizing the melt to form a boron-containing titanium alloy powder;

consolidating the boron-containing titanium alloy powder to form a consolidated boron-containing titanium alloy powder; and heating the consolidated boron-containing titanium alloy powder above a beta transus temperature of the consolidated boron-containing alloy powder to force supersaturated boron out of a titanium lattice of the boron-containing titanium alloy powder and to increase an interparticle spacing in a distribution of titanium boride particles in the consolidated boron-containing titanium alloy powder.

30. The method of claim 29, further comprising maintaining the carbon concentration of the consolidated boron-containing titanium alloy powder below a predetermined limit to avoid embrittlement.

31. The method of claim 30, wherein the predetermined limit is no greater than 0.1 weight percent.

32. The method of claim 29, further comprising cooling the consolidated boron-containing titanium alloy powder from the temperature above the beta transus temperature at a rate slow enough to prevent reduced ductility.

33. The method of claim 29, further comprises thermomechanically processing the consolidated boron-containing titanium alloy powder at a deformation rate that does not damage the titanium boride particles of the consolidated boron-containing titanium alloy powder.

34. The method of claim 33, wherein the steps of heating the consolidated boron-containing titanium alloy powder above the beta transus temperature and thermomechanically processing the consolidated boron containing titanium alloy powder occur simultaneously.

35. The method of claim 33, wherein thermomechanically processing the consolidated boron-containing titanium alloy powder comprises at least one of forging, extruding, and rolling the consolidated boron-containing titanium alloy powder.

36. The method of claim 33, wherein thermomechanically processing the consolidated boron-containing titanium alloy powder comprises extruding the consolidated boron-containing titanium alloy powder at a ram speed no greater than 15 inch/mm.

37. The method of claim 29, wherein the boron is in liquid or powder form.

38. The method of claim 29, wherein the molten titanium alloy is selected from the group consisting of Ti-6Al-4V alloy, Ti-5Al-2.5Sn alloy, and Ti-6Al-2Sn-4Zr-2Mo-0.1Si alloy.

* * * * *